United States Patent [19]

Osborne

[11] Patent Number: 4,806,898

[45] Date of Patent: Feb. 21, 1989

[54] POLYPHASE INTERRUPTER RESPONSIVE TO SINGLE PHASE FAULT

[75] Inventor: Anthony Osborne, Duluth, Ga.

[73] Assignee: Kearney-National, Inc., Atlanta, Ga.

[21] Appl. No.: 194,269

[22] Filed: May 16, 1988

[51] Int. Cl.[4] ..... H01H 71/20; H01H 73/24

[52] U.S. Cl. ..... 337/146; 337/154

[58] Field of Search ..... 337/142, 143, 144, 145, 337/146, 147, 148, 149, 150, 151, 152, 153, 154, 15, 32, 244, 180, 181; 361/102, 103

[56] References Cited

U.S. PATENT DOCUMENTS 3,287,521 11/1966 Gryctko et al. ..... 337/146

FOREIGN PATENT DOCUMENTS 466604 7/1950 Canada ..... 337/154

*Primary Examiner*—H. Broome

*Attorney, Agent, or Firm*—Rodgers & Rodgers

[57] ABSTRACT

A polyphase interrupter includes an electric fuse in series with each phase, a phase grounding conductor electrically connected with each phase and movably mounted adjacent and electrically connected with a terminal of each fuse, biasing means arranged to impart individual grounding movement to each phase grounding conductor, latch means normally in engagement with each phase grounding conductor for preventing grounding movement thereof, actuating means associated with each of said fuses and movable into releasing engagement with the associated latch means in response to current interrupting operation of the associated fuse, and coupling means interconnecting all of said latch means for imparting simultaneous releasing movement thereby to effect grounding and interruption of all phases in response to interruption in one phase.

10 Claims, 2 Drawing Sheets

POLYPHASE INTERRUPTER RESPONSIVE TO SINGLE PHASE FAULT

This inventon relates to polyphase electric systems and is primarily applicable to distribution systems.

BACKGROUND ART

U.S. Pat. No. 4,413,246 issued Nov. 1, 1983 and owned by the assignee of this invention discloses a circuit interrupter in the form of an electric fuse which preferably is employed in the practice of this invention.

U.S. Pat. No. 4,322,706 issued Mar. 30, 1982 and owned by the assignee of this invention pertains to a striker device which may be used in conjunction with the fuse of U.S. Pat. No. 4,413,246 to indicate an interrupted condition of the fuse by simply causing a plunger to protrude outwardly through one end of the associated fuse in response to interruption of the circuit controlled by that fuse. This or a similar plunger may be utilized in accordance with one aspect of this invention.

U.S. Pat. No. 3,917,374 issued Nov. 4, 1975 and owned by the assignee of this invention discloses connecting means whereby a device formed according to this invention may be easily connected and disconnected from an associated polyphase circuit.

SUMMARY

All phases of a polyphase circuit are interrupted in response to an interrupting operation in one phase by means of a phase grounding conductor electrically connected with each phase and movably mounted adjacent each phase interrupter, biasing means arranged to impart grounding movement to each phase grounding conductor, latch means normally in engagement with each phase grounding conductor for preventing grounding movement thereof, actuating means associated with each current interrupter and moveable into releasing engagement with the associated latch means in response to a current interrupting operation in the associated phase and coupling means interconnecting all of the latch means for imparting simultaneous releasing movement thereto thereby to effect grounding and interruption of all phases in response to interruption of the current in one phase.

BRIEF DESCRIPTION ON THE DRAWINGS

In the drawings FIG. 1 is a perspective view of an interrupter formed according to this invention as viewed from the outside;

BEST MODE OF CARRYING OUT THE INVENTION

Figure 1:
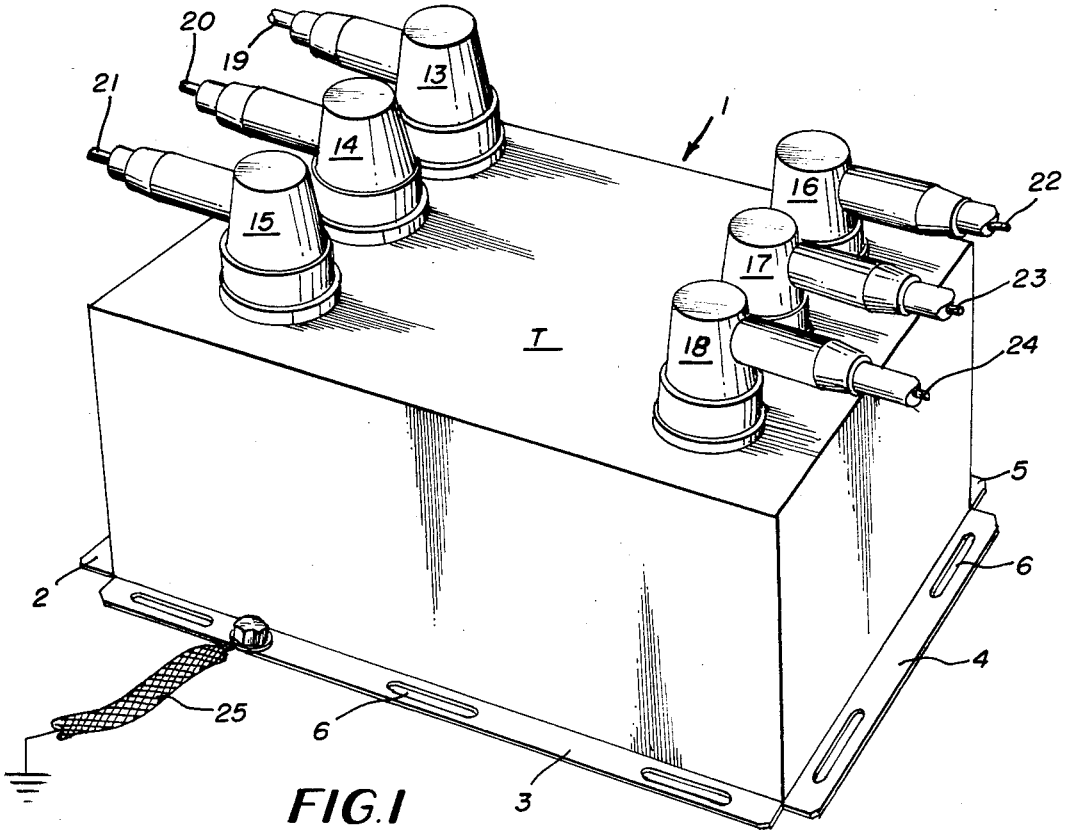
Figure 2:
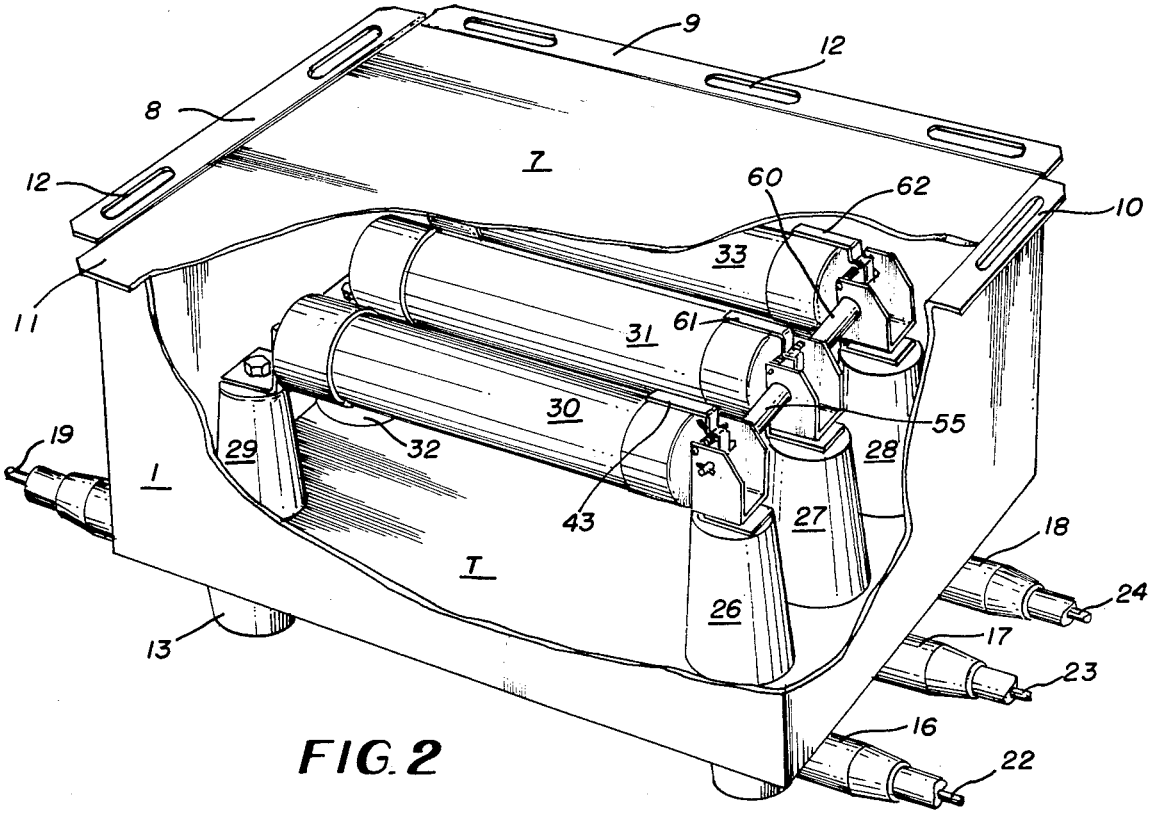
FIG. 2 is a view somewhat similar to FIG. 1 but shows the apparatus in inverted condition and with parts of the housing broken away.

In FIGS. 1 and 2, a cubical housing designated by the numeral 1 is provided with side flanges 2, 3, 4 and 5 each of which includes a plurality of apertures such as are indicated by the numeral 6.

The polyphase interrupter 1 is provided with a closure plate 7 having edges 8, 9, 10 and 11. Each of these edges includes a plurality of apertures such as are indicated by the numeral 12 in FIG. 2. Closure plate 7 is secured in gas tight relation to the housing 1 by means of a suitable gasket and a welded seal so as to form a gas tight enclosure for the interrupters located within the housing. The housing is filled with sulphur hexafluoride gas which serves as insulation. Apertures 6 may be used to support the structure.

The polyphase interrupter as shown in FIGS. 1 and 2 is connected with a polyphase circuit by means of conventional elbow connectors such as are indicated by the numerals 13, 14, 15, 16, 17 and 18. The conductors such as 19, 20 and 21 may be connected with a source of electric power or with an electric load. Similarly the conductors 22, 23 and 24 may form parts of a circuit connected with a source of polyphase power or with a load.

The housing 1 and its closure plate 7 are grounded by any suitable means as indicated at 25.

For cooperating with the elbow connectors such as 16, 17 and 18, bushings 26, 27 and 28 are provided and disposed in coincidental relation with openings in the top T of housing 1 and are secured in gas tight relation to the top T. These connectors and their associated bushings are conventional and may take the form disclosed in U.S. Pat. No. 3,917,374. In like fashion, the elbow connector such as 13 cooperates with an associated bushing 29. Bushings 26 and 29 afford support for fuse 30. Fuse 31 is supported by bushing 27 and 32 while fuse 33 is supported by bushing 28 and another bushing not observable in FIG. 2.

Figure 3:
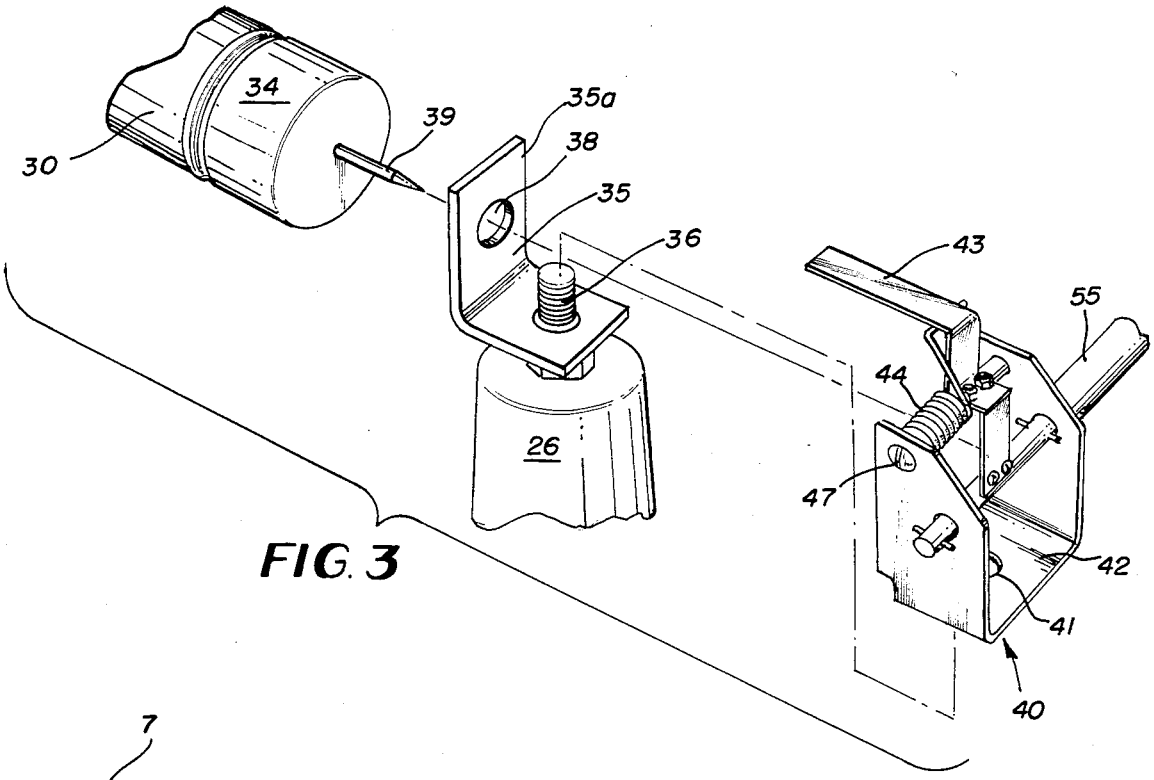
FIG. 3 is an exploded view of certain operative parts formed according to this invention and which are associated with each phase of the polyphase interrupter as shown in FIGS. 1 and 2.
Figure 4:
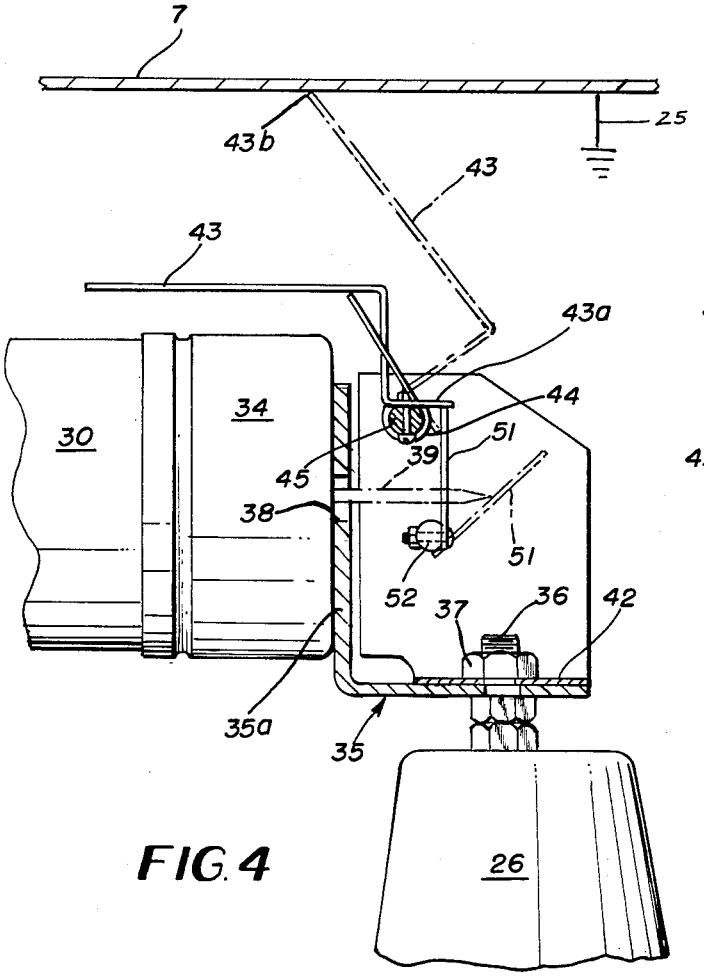
FIG. 4 is a view showing the essential elements of FIG. 3 in assembled condition and FIG. 5 is a view of FIG. 4 as seen from the right hand side of FIG. 4.
Figure 5:
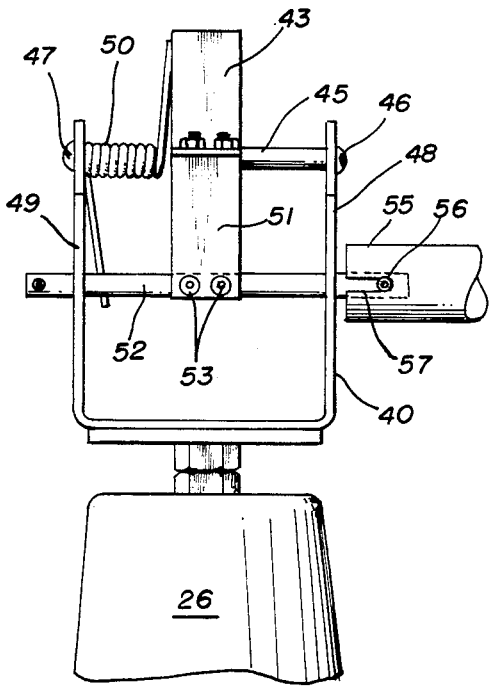

With reference to FIGS. 3, 4 and 5, the fuse 30 includes a conductive end cap such as is indicated at 34. Of course an end cap such as 34 is provided at each end of each of the fuses such as 30, 31 and 33. The L-shaped conductor 35 is mounted atop bushing 26 and is secured thereto by conducting stud 36 which is externally threaded and which cooperates with nut 37 to hold the L-shaped conductor 35 in place atop bushing 26. Conductor 35 includes a vertical leg 35*a* in which an aperture 38 is provided and which is welded to cap 34. Aperture 38 is an opening through which plunger 39 may project from inside the cup shaped cap 34. Operation of plunger 39 is in accordance with the aforementioned U.S. Pat. No. 4,322,706 or with a similar device. Outward movement of plunger 39 occurs upon the blowing of fuse 30.

In accordance with features of this invention, a U-shaped bracket 40 is provided with an aperture 41 formed in the bight portion 42 of bracket 40. Aperture 41 receives the bolt 36. The nut 37 secures the bight portion 42 of bracket 40 into secure conductive relation with the conductor 36. An L-shaped phase grounding conductor 43 is provided with a generally cylindrical portion 44 which is disposed about the rod 45 which is secured at its ends by means of screws 46 and 47 to the upright prongs 48 and 49 of the U-shaped bracket 40. Biasing means 50 in the form of a coil spring is arranged so as to urge phase grounding conductor 43 for rotation in a clockwise direction as viewed in FIGS. 3 and 4 about the rod 45.

Phase grounding conductor 43 is normally secured against rotation by latch means 51 which is fixedly secured to oscillatable shaft 52 by bolts 53. Shaft 52 is journalled in prongs 48 and 49 of bracket 40.

A fault such as a fault to ground involving circuit elements such as 19 or 22 effects operation of fuse 30 and in turn causes the actuating means in the form of plunger 39 to move from its normal position within the cup shaped structure 34 through the aperture 38 therein and into engagement with the latch means 51 to cause that latch to swing in a clockwise direction about the oscillatable shaft 52. This action causes the tab 51 and its associated oscillatable shaft 52 to rotate in a clockwise direction to occupy the position shown in phantom lines in FIG. 4. This action causes the end of the tab 51 which is opposite from the shaft 52 to disengage the portion 43*a* of phase grounding conductor 43 and frees that conductor to swing to the position indicated in phantom lines in FIG. 4 so that the outer end 43*b* of phase grounding conductor 43 engages the closure plate 7 of the housing 1 which effects additional grounding of the circuit 19, 22. Simultaneously coupling means such as 55 which is secured to shaft 52 by pins 56 and slot 57 is caused to rotate through a limited angle in unison with oscillatable shaft 52. Of course the right hand end of coupling device 55 is interconnected with the oscillatable device such as 52 associated with bushing 27 and fuse 31. Similarly coupling device 60 interconnects the oscillatable shaft associated with bushing 27 and fuse 31 with the oscillatable shaft associated with bushing 28 and fuse 33. The result is that interruption of the flow of current through fuse 30 and operation of that fuse initiates operation in unison of the phase grounding conductors 61 and 62 so that all three phases of the system are interrupted in response to the operation of fuse 30. Of course blowing of fuse 31 or 33 similarly causes blowing of the other two fuses.

I claim:

1. A system for interrupting the flow of electric current in all phases of a polyphase circuit in response to interruption of the flow of current in one phase, said system comprising a current interrupter in series with each phase, a phase grounding conductor electrically connected with each phase and movably mounted adjacent each of said current interrupters, biasing means in engagement with each of said phase grounding conductors and arranged to impart grounding movement thereto, latch means normally in engagement with each of said phase grounding conductors for preventing grounding movement thereof, actuating means associated with each of said current interrupters and movable into releasing engagement with the associated latch means in response to a current interrupting operation of the associated current interrupter, and coupling means interconnecting all of said latch means for imparting simultaneous releasing movement thereto thereby to effect grounding and interruption of all phases.

2. A system according to claim 1 wherein said current interrupters are electric fuses.

3. A system according to claim 1 wherein said each of said phase grounding conductors is pivotally mounted on a conductive bracket secured to one terminal of each of said current interrupters.

4. A system according to claim 1 wherein each of said grounding conductors includes a portion rotatably disposed about a rod fixedly mounted on a bracket secured to one terminal of each of said current interrupters.

5. A system according to claim 4 wherein each of said biasing means comprises a coil spring disposed about the associated one of said rods.

6. A system according to claim 1 wherein each of said latch means comprises a shaft journally mounted on a bracket secured to one terminal of each of said current interrupters and a tab secured at one end thereof to each of said shafts and arranged so that its other end is engageable with a part of the associated one of said phase grounding conductors.

7. A system according to claim 1 wherein each of said current interrupters comprises an electric fuse and wherein each of said actuating means comprises a plunger coaxial with a different one of said fuses.

8. A system according to claim 7 wherein each of said plungers is movable out of an end of its associated fuse in response to a circuit interrupting operation thereof.

9. A system according to claim 1 wherein said current interrupters are aligned in side by side parallel relation and wherein said coupling means comprises a plurality of connecting links formed of insulating material and arranged with each end interconnected with an end of an oscillatable shaft journally mounted on a bracket mounted on corresponding ends of said current interrupters so that latch tabs secured to said oscillatable shafts are moved in unison simultaneously.

10. A system according to claim 1 wherein a U-shaped bracket is electrically connect with one terminal of each of said current interrupters.

* * * * *